US008307795B2

(12) United States Patent
Meintschel et al.

(10) Patent No.: US 8,307,795 B2
(45) Date of Patent: Nov. 13, 2012

(54) INTERNAL COMBUSTION ENGINE VALVE DRIVE TRAIN SWITCHING DEVICE

(75) Inventors: Jens Meintschel, Bernsdorf (DE); Thomas Stolk, Kirchheim (DE); Alexander von Gaisberg-Helfenberg, Beilstein (DE)

(73) Assignee: Daimler AG, Stuttgart (DE)

( * ) Notice: Subject to any disclaimer, the term of this patent is extended or adjusted under 35 U.S.C. 154(b) by 407 days.

(21) Appl. No.: 12/660,929

(22) Filed: Mar. 5, 2010

(65) Prior Publication Data

US 2010/0199945 A1 Aug. 12, 2010

Related U.S. Application Data

(63) Continuation-in-part of application No. PCT/EP2008/007075, filed on Aug. 29, 2008.

(30) Foreign Application Priority Data

Sep. 8, 2007 (DE) ..... 10 2007 042 932

(51) Int. Cl.
*F01L 1/34* (2006.01)

(52) U.S. Cl. ..... 123/90.16; 123/90.31; 74/569

(58) Field of Classification Search ..... 123/90.16, 123/90.31; 74/569
See application file for complete search history.

(56) References Cited

U.S. PATENT DOCUMENTS

| | | | | |
|---|---|---|---|---|
| 5,289,806 | A * | 3/1994 | Hurr | 123/90.17 |
| 5,697,333 | A | 12/1997 | Church et al. | |
| 6,561,146 | B2 * | 5/2003 | Todd et al. | 123/90.15 |
| 2005/0011480 | A1 * | 1/2005 | Schultz et al. | |

FOREIGN PATENT DOCUMENTS

| | | |
|---|---|---|
| DE | 42 30 877 | 4/1993 |
| DE | 195 19 048 | 11/1996 |
| DE | 196 11 641 | 6/1997 |
| DE | 198 04 323 | 8/1999 |
| DE | 10 2004 021 375 | 1/2006 |
| DE | 10 2004 051 427 | 5/2006 |
| EP | 0 579 592 | 1/1994 |
| EP | 1 279 799 | 1/2003 |
| EP | 1 503 048 | 2/2005 |
| JP | 2003 049672 | 2/2003 |

* cited by examiner

*Primary Examiner* — Ching Chang
(74) *Attorney, Agent, or Firm* — Klaus J. Bach

(57) ABSTRACT

In an internal combustion engine valve drive train switching device, at least one safety device is provided for preventing an unscheduled switching of a valve train switching unit.

10 Claims, 3 Drawing Sheets

INTERNAL COMBUSTION ENGINE VALVE DRIVE TRAIN SWITCHING DEVICE

This is a Continuation-in-Part application of pending international patent application PCT/EP2008/007075 filed Aug. 29, 2008 and claiming the priority of German patent application 10 2007 042 932.2 filed Sep. 8, 2008.

BACKGROUND OF THE INVENTION

DE 10 2004 021 375 A1 discloses an internal combustion engine valve drive train switching device, where two switching means can each actuate a valve drive switching unit in principal at any time during operation wherein one of the valve drive train switching unit is associated with one and the other with the other switching direction.

It is specifically the object of the present invention to provide an internal combustion engine valve drive train switching device in such a manner that a safe operation is achieved with a simple and cost-efficient design.

SUMMARY OF THE INVENTION

In an internal combustion engine valve drive train switching device, at least one safety unit is provided for preventing an undesired switching of a valve train switching unit.

"Provided" means to be specially equipped, and/or designed and/or programmed. A "safety unit" is a unit, which, in at least one time span of an operation, prevents an interaction and especially a mechanical and/or electrical interaction between at least two construction units, which can especially be formed as at least one switching means and at least one valve drive train switching unit, specifically in that at least one of the constructional units is covered and/or shielded and/or deactivated and/or restricted in its mode of operation within the time span so that a mechanical and/or electrical and/or hydraulic and/or pneumatic interaction between the constructional units is prevented. The safety unit "shielding" one of the constructional units is covered and/or shielded and/or deactivated and/or restricted in its mode of operation within the time span, so that a mechanical and/or electrical and/or hydraulic and/or pneumatic interaction between the constructional units is prevented. The safety unit "shielding" one of the constructional units means that the safety unit is arranged between the constructional unit and a further constructional unit. A "switching means" is a means, which is provided to effect a switching process, especially also in cooperation with at least one switching unit and/or a valve drive train switching unit or another unit. A "switching" is a relative movement and especially an axial relative movement between two constructional units and/or components. An "unscheduled or undesired" switching is a switching which is not planned or programmed and/or scheduled in a provided and/or programmed operating course. A "valve drive train switching unit" is a unit, which is provided to effect a switching process, especially also in cooperation with at least one switching means and/or another unit and especially a switching process of at least one valve train. A "switching process" is a relative movement and especially an axial relative movement between two constructional units and/or components. A safe operation can be achieved with a design according to the invention.

It is further suggested that the safety unit is provided to prevent an unscheduled interaction of at least one switching means with the valve train switching unit. An "interaction" is a mechanical and/or an electrical interaction. A simple construction of the safety unit can be achieved hereby.

The safety unit is advantageously provided to prevent an unscheduled switching of at least one of the valve train switching units in a purely mechanical manner. A cost-efficient, reliable safeguarding can be achieved therewith.

In a preferred arrangement of the invention, the safety unit is provided to prevent an interaction between one of the switching means and a further one of the valve train switching units due to an interaction of at least one switching means with the valve train switching unit. A simple and chronologically scheduled provision of a safeguarding can be achieved hereby.

The safety unit is preferably provided to prevent at least one interaction between the valve train switching unit and at least one switching means in dependence on at least one switching state of the valve train switching unit. A "switching state" refers to a position of at least one of the valve trains switching units relative to at least one switching means and/or to at least one cylinder. A differentiated safeguarding can hereby be achieved especially corresponding to prevalent safeguarding requirements.

The safety unit is provided to prevent a switching of the valve train switching unit in dependence on an angle of rotation in an advantageous embodiment of the invention. An "angle of rotation" is especially meant to be an angle of a shaft during a rotation and especially an angle of a camshaft during a rotation which describes a rotational state and/or rotation state. A simple control of the safety unit can be achieved with an arrangement according to the invention.

It is further suggested that the safety unit is provided to enable an interaction between one of the switching means and a further valve train switching unit due to an interaction of at least one switching means with the valve train switching unit. The safety unit can hereby be deactivated in a constructively simple manner.

The safety unit is advantageously a covering unit. A "covering unit" is a unit which is arranged between two constructional units in one operating mode, which can especially be formed as switching means and as a valve train switching unit, and, as a result, prevents an interaction therewith. A unit arranged "between" two constructional units means that at least one point of a constructional unit and at least one point of the other constructional unit is present, and a line which extends between the two points intersects and/or penetrates the unit. A cost-efficient and reliable safeguarding can especially be achieved with the arrangement according to the invention.

It is further suggested that the safety unit is formed integrally with one of the valve drive train switching units. A coupling with a switching state of the valve drive train switching units and especially an easy control of the safety unit can be achieved hereby.

The invention will become more readily apparent from the following description of preferred embodiments of the invention described below with reference to the accompanying drawings.

DESCRIPTION OF PARTICULAR EMBODIMENTS

Figure 1:
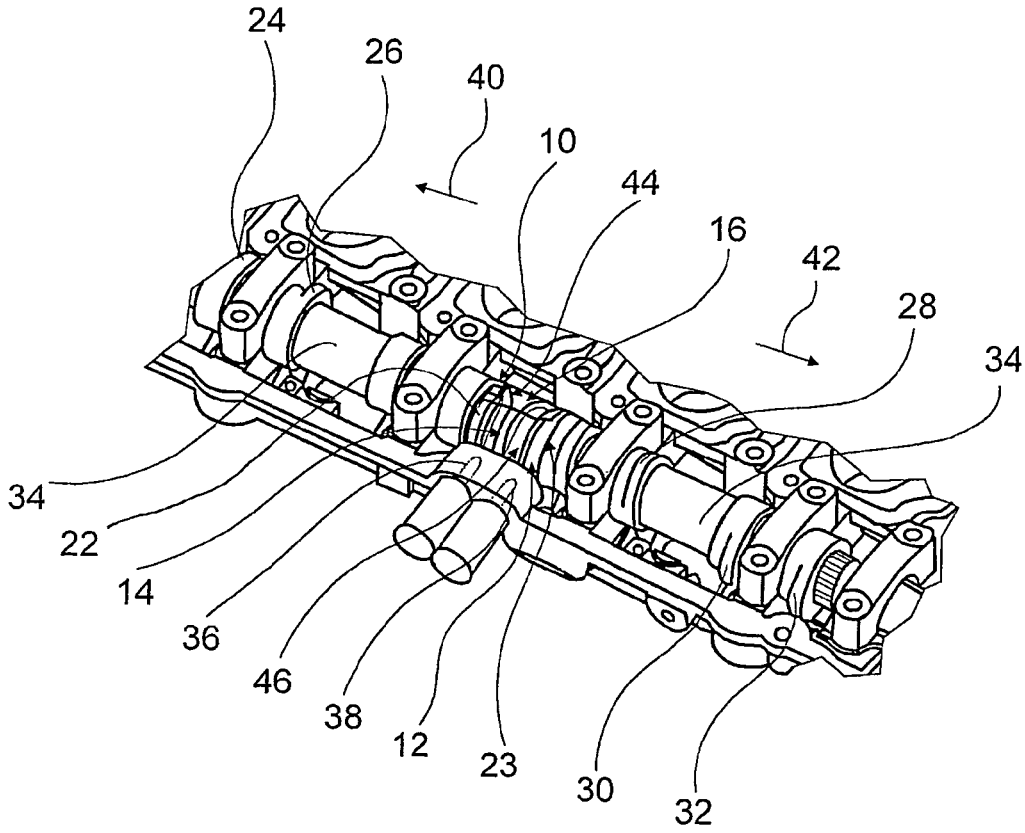
FIG. 1 shows an internal combustion engine valve drive train switching device.

FIG. 1 shows an internal combustion engine valve drive train switching device with two safety units 10, 12, which are provided to prevent an unscheduled switching of at least two valve train switching units 14, 16. During an operation of the internal combustion engine valve drive train switching device, cams 24, 26 are displaced relative to valves which are activated by the cams 24, 26 in an operating mode during a rotation of the camshaft during a switching of the valve train switching unit 14. This effects a change of the valve lift curves of the valves. Analogously, during an operation of the internal combustion engine valve drive train switching device, cams 28, 30, 32 are displaced along the camshaft 34 relative to valves which are activated by the cams 28, 30, 32 in the operating mode with a rotation of the camshaft 34 upon switching of the valve drive train switching unit 16. The valve drive train switching units 14, 16 are switched in the operating mode in two direction 40, 42 along the camshaft 34 by switching them successively in respectively one of the directions 40, 42, wherein during the rotation of the camshaft 34 due to an engagement by a switching means 36, 38, a mechanical interaction takes place between one of the switching means 36, 38 and the two valve drive train switching units 14, 16. The valve drive train switching units 14, 16 are displaced in the direction 40 due to a mechanical interaction with the switching means 36. The valve drive train switching units 14, 16 are displaced in the direction 42 in the operating mode due to a mechanical interaction with the switching means 38. The valve drive train switching units 14, 16 together form guide grooves 44, 46, which interact with the switching means 36, 38 in the operating mode. With regard to a camshaft angle of rotation, the valve drive train switching units 14, 16 respectively, form an angular region of more than 180° of respectively one of the guide grooves 44, 46.

During and after a switching process of the valve switching unit 14 in the direction 40, the safety device 12 covers a part of the guide groove 46, so as to prevent an unscheduled interaction of the switching means with the control guide groove 46 and thus an unscheduled switching of the valve train switching unit 16 by the switching means 38. During and after a switching process of the valve train switching unit 16 in the direction 42, the safety unit 10 analogously covers a part of the guide groove 44 to prevent an unscheduled interaction of the switching means 36 with the guide groove 44 and thus an unscheduled switching of the valve train switching unit 14 by the switching means 36. The safety units 10, 12 thus prevent the unscheduled switching of the valve drive train switching units 14, 16 in a purely mechanical manner. The valve drive train switching units 14, 16 are furthermore identical to covering units 22, 23 due to the partial covering of the guide grooves 44, 46.

Figure 2:
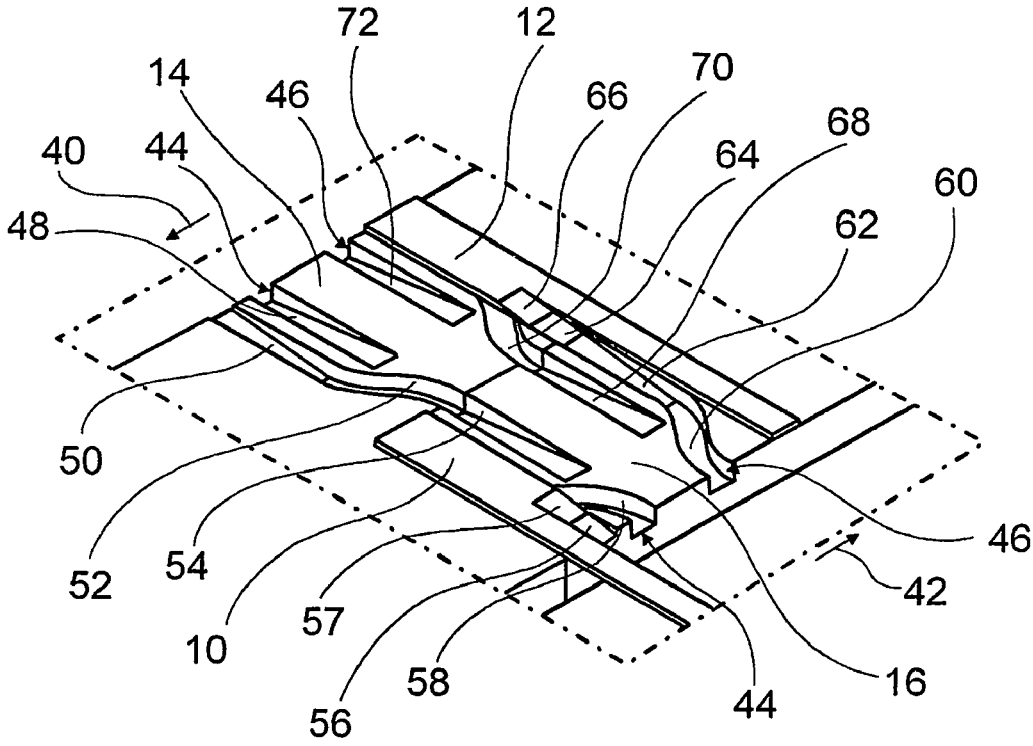
FIG. 2 shows a development of two valve drive train switching units and two safety units.
Figure 4:
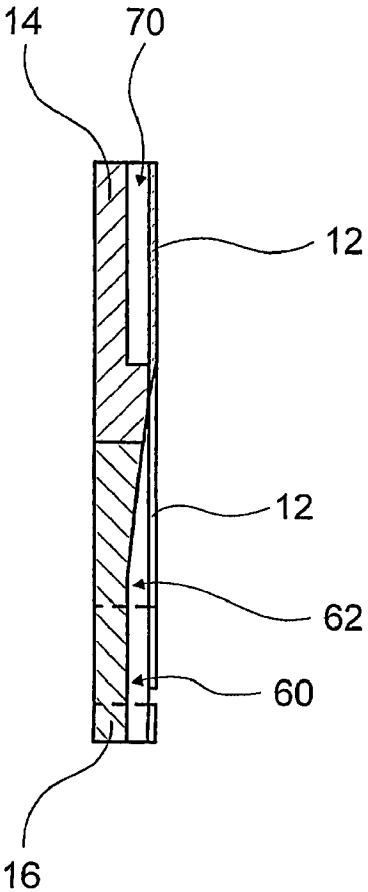
FIG. 4 is a sectional view along line A-A in FIG. 3.
Figure 3:
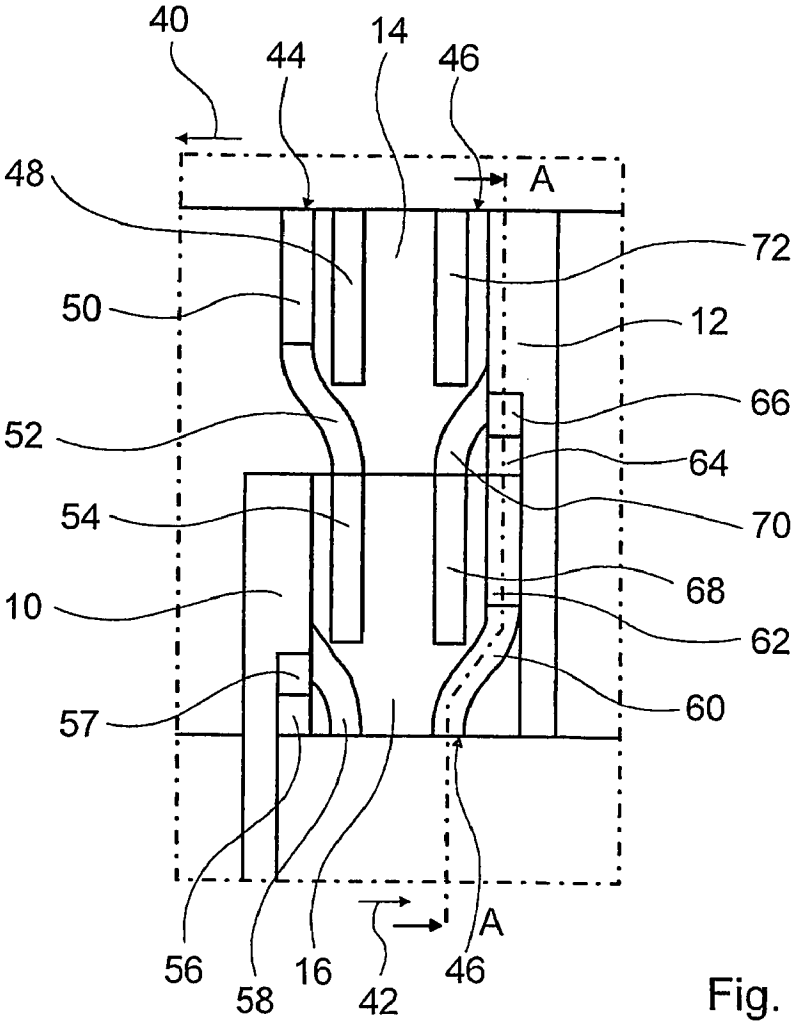
FIG. 3 is a top view of the development.

FIGS. 2 and 3 show a development of the valve drive train switching units 14, 16 and of the safety units 10, 12 in a plane which surrounds the camshaft 34 when the camshaft is assembled. The safety unit 10 which is L-shaped in the representation is formed integrally with the valve drive train switching unit 14 and covers a part of the valve drive train switching unit 16. The L-shaped safety unit 12 is formed integrally with the valve drive train switching unit 16 and covers a part of the valve drive train switching unit 14. The valve drive train switching unit 14*b* has partial regions 48, 50, 52, 64, 70, 72 of grooves. The valve train switching unit 16 also comprises partial regions 54, 56, 58, 60, 62, 68 of grooves. The safety unit 10 has a chamfered partial region 57, which abuts the partial region 56. Also, the safety unit 12 comprises a chamfered partial region 66, which abuts the partial region 64 (see also FIG. 4). The partial regions 48, 50, 52, 54, 56, 57, 58 form a guide groove 44. The partial regions 60, 62, 64, 66, 68, 70, 72 form a guide groove 46.

In the following a switching process of the valve drive train switching units 14, 16 in the direction 40 is described. At the beginning of the switching process, a part of the partial region 58 is covered by the safety unit 10, so that the safety unit 10 prevents an unintended interaction of the switching means 36 with the valve drive train switching unit 16 and thus an undesired switching of the valve drive train switching unit 16. The safety devices 10, 12 are also provided to prevent a switching of the valve drive train switching units 14, 16 in dependence on the angle of rotation. The switching process starts in that the switching means 36 moves into the partial region 57, which opens into the partial region 56. The switching means 36 moves into the partial region 50 via the partial region 56. As the partial regions 56, 57, 50 proceed orthogonally to the direction 40, the valve drive train switching units 14, 16 remain motionless when passing through the partial regions 56, 47, 50 by the switching means in the directions 40, 42. The switching means 36 moves into the partial region 52 via the partial region 50. As the partial region 52 is curved, a mechanical interaction between the switching means 36 and the partial region 52 and thus the valve train switching unit 14 takes place, which leads to a displacement of the valve train switching unit 14 along the camshaft 34 in the direction 40 relative to the switching means 36, 38. Due to the fact that the safety device 10 is formed integrally with the valve drive train switching unit 14, a displacement of the safety device 10 in the direction 40 relative to valve train switching unit 16 is effected with the displacement of the valve train switching unit 14 along the camshaft 34 in the direction 40, which uncovers a part of the partial region 58 and results to a moving of the switching means into the partial region 58 of the valve drive train switching unit 16 due to the rotation of the camshaft 34. The safety unit 10 is also provided to enable an interaction between one of the switching means 36, 38 and the valve drive train switching unit 14 due to an interaction of at least one of the switching means 36, 38 with the valve train switching unit 14. With the moving of the switching means 36 into the partial region 58, a displacement of the valve drive train switching unit 16 in the direction 40 relative to the switching means 36, 38 takes place due to the camshaft rotation and a curvature of the partial region 58. As the safety unit 12 is formed integrally with the valve drive train switching unit 16, a displacement of the safety device 12 in the direction 40 also takes place during the displacement of the valve train switching unit 16. A part of the partial region 70, which could previously be engaged, is in principle covered hereby. The safety unit 12 is also provided to prevent an interaction between the switching means 38 and the valve drive train switching unit 14 due to an interaction of the switching means 36 with the valve drive train switching unit 16. After passing through the partial region 58, the switching means enters the partial region 48, where it is moved back to its starting position out of the partial region 48 by ascension of the groove.

A switching of the two valve train switching units 14, analogously occurs in the direction 42. The switching means moves into the partial region 66 and afterwards into the partial region 64 (FIG. 4), displaces the valve drive train switching unit 16 in the partial region 60 in the direction 42, moves into the opened partial region 70, and displaces the valve drive train switching unit 14 in the direction 42. Afterwards, the switching means 38 is pushed back out of the partial region 68 into its starting position.

What is claimed is:

1. An internal combustion engine valve drive train switching device having two axially overlapping valve train switching units (14, 16) provided with cam shifting structures for the valves of different cylinders and forming together guide tracks (44, 46), and switching means (36, 38) which cooperate with the guide tracks (44, 46) in one operating mode and two safety units (10, 12), which are provided to prevent an undesired switching of one of the valve drive train switching units (14, 16)) by covering part of the guide tracks (44, 46), and also an undesired co-operation of one of the switching means (36, 38) with the valve drive train switching units (14, 16), the safety units (10, 12) by interaction of the switching means (36, 38) with one of the valve train switching units (14, 16) permitting an interaction between the other switching means (36, 38) and the other valve train switching unit (14, 16) as a result of a displacement of the one valve train switching unit (14, 16) relative to the switching means (36, 38) which effects a displacement of the safety unit (10, 12) which causes an uncovering of a partial area of the guide tracks (44, 46).

2. The internal combustion engine valve drive train switching device according to claim 1, wherein each safety unit (10, 12) is provided to inhibit an undesired interaction of at least one switching means (36, 38) with one of the valve train switching units (14, 16).

3. The internal combustion engine valve drive train switching device according to claim 2, wherein each safety unit (10, 12) is provided to prevent an unscheduled switching of at least one of the valve train switching units (14, 16) in a purely mechanical manner.

4. The internal combustion engine valve drive train switching device according to claim 2, wherein each safety unit (10, 12) is provided to prevent an interaction between one of the switching means (36, 38) and a further valve train switching unit (14, 16) due to an interaction of at least one of the switching means (14, 16) with one of the valve train switching units (14, 16).

5. The internal combustion engine valve drive train switching device according to claim 2, wherein each safety unit (10, 12) is provided to prevent at least one interaction between the valve drive train switching unit (14, 16) and at least one of the switching means (36, 38) in dependence on at least one switching state of one of the valve train switching units (14, 16).

6. The internal combustion engine valve drive train switching device according to claim 2, wherein each safety unit (10, 12) is provided to prevent a switching of one of the valve train switching units (14, 16) in dependence on an angle of rotation.

7. The internal combustion engine valve drive train switching device according to claim 1, wherein each safety unit (10, 12) is provided to enable an interaction between one of the switching means (36, 38) and a further valve train switching unit (14, 16) due to an interaction of at least one switching means (36, 38) with one of the valve train switching units (14, 16).

8. The internal combustion engine valve drive train switching device according to claim 1, wherein the safety unit (10, 12) each is a covering unit (22, 23), which covers part of the valve train switching unit (14, 16) for preventing an undesired switching by the switching means (36, 38).

9. The internal combustion engine valve drive train switching device according to claim 1, wherein each safety unit (10, 12) is formed integrally with the valve train switching unit (14, 16).

10. An internal combustion engine valve drive train switching safety device operating method with a valve drive train switching unit (14, 16) having two axially overlapping valve train switching units (14, 16) provided with cam shifting structures for the valves of different cylinders and forming together guide tracks (44, 46), and switching means (36, 38) which cooperate with the guide tracks (44, 46) in one operating mode and two safety units (10, 12), which are provided to prevent an undesired switching of at least one valve drive train switching unit (14, 16), said method including the step of preventing an unscheduled switching of at least one valve train switching unit (14, 16), wherein the safety units (10, 12) cover, during and after a switching procedure, part of the guide tracks (44, 46) in order to prevent an unintended interaction between one of the switching means and a guide track (44, 46) and an undesired switching of the valve train switching unit (14, 16), but wherein, as a result of an interaction between one of the switching means (36, 36) and a valve train switching unit (14, 16), an interaction between a switching means (36, 38) and another valve train switching unit (14, 16) is made possible by a displacement of a valve drive switching unit (14, 16) relative to the switching means (36, 38) which causes a displacement of the safety unit (10, 12) relative to the other valve train switching unit (14, 16) by which a part of a guide track (44, 46) is uncovered.

* * * * *